US009008530B2

(12) United States Patent
Song et al.

(10) Patent No.: US 9,008,530 B2
(45) Date of Patent: Apr. 14, 2015

(54) IMAGE FORMING APPARATUS AND POWER CONTROL METHOD THEREOF

(75) Inventors: Hyun-soo Song, Suwon-si (KR); Sang-gyu Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 434 days.

(21) Appl. No.: 13/067,103

(22) Filed: May 9, 2011

(65) Prior Publication Data

US 2012/0128385 A1 May 24, 2012

(30) Foreign Application Priority Data

Nov. 23, 2010 (KR) ..... 10-2010-0116623

(51) Int. Cl.
*G03G 15/00* (2006.01)

(52) U.S. Cl.
CPC .. *G03G 15/5004* (2013.01); *G03G 2215/00426* (2013.01)

(58) Field of Classification Search
USPC ..... 399/37, 9, 38, 46, 88, 385, 408, 410, 399/411, 407, 409, 82, 85, 401
See application file for complete search history.

(56) References Cited

U.S. PATENT DOCUMENTS

| | | | | |
|---|---|---|---|---|
| 6,847,794 | B2 * | 1/2005 | Namura | 399/88 |
| 2007/0285717 | A1 * | 12/2007 | Muto et al. | 358/1.16 |
| 2009/0070604 | A1 * | 3/2009 | Kumakura | 713/310 |
| 2010/0260506 | A1 * | 10/2010 | Naruse | 399/9 |
| 2012/0148229 | A1 * | 6/2012 | Tamura | 396/529 |
| 2013/0111244 | A1 * | 5/2013 | Yokomizo | 713/323 |

FOREIGN PATENT DOCUMENTS

JP 2010002606 A * 1/2010

* cited by examiner

*Primary Examiner* — Benjamin Schmitt
*Assistant Examiner* — Matthew Miller
(74) *Attorney, Agent, or Firm* — Staas & Halsey LLP

(57) ABSTRACT

An image forming apparatus and a power control method thereof, the power control method of an image forming apparatus which includes a finisher to perform at least one of finishing jobs including arranging, sorting, grouping, folding, stapling, binding, and punching a print medium which is ejected after an image is formed thereon, the power control method including: determining whether or not a power mode of the image forming apparatus meets requirements for entering a power save mode in which power supplied to a part of elements of the image forming apparatus is shut off; determining whether or not the image forming apparatus has an ongoing job if the requirements for entering the power save mode are met; and entering the image forming apparatus in the power save mode while the power supply to the finisher is maintained if the image forming apparatus has the ongoing job.

13 Claims, 8 Drawing Sheets

IMAGE FORMING APPARATUS AND POWER CONTROL METHOD THEREOF

CROSS-REFERENCE TO RELATED APPLICATIONS

This application claims priority benefit from Korean Patent Application No. 10-2010-0116623, filed on Nov. 23, 2010 in the Korean Intellectual Property Office, the disclosure of which is incorporated herein by reference.

BACKGROUND

1. Field

Apparatuses and methods consistent with the exemplary embodiments relate to an image forming apparatus and a power control method thereof, and more particularly, to an image forming apparatus and a power control method thereof which performs a finishing job with respect to a print medium on which an image is formed.

2. Description of the Related Art

An image forming apparatus prints an image on a print medium according to an input image signal, and may be classified into an inkjet type, a thermal transfer type and an electrophotographic type according to a print method. The image forming apparatus may include a printer, a photocopier, a facsimile, or a multi-function peripheral (MFP) having two or more functions.

In recent years, there is a rising demand for an image forming apparatus providing not only a print function but also providing scanning and faxing functions like an MFP and an office automation device. The image forming apparatus has been developed to provide high performance and extend its inherent functions.

Accordingly, the image forming apparatus may be connected to or include a finisher which performs a finishing job to a print medium which is printed.

The finisher arranges, sorts, groups, binds, folds, staples and punches the printed print medium.

The image forming apparatus may have a low power mode or a power save mode in which power supplied to some of elements is shut off to save power consumption when a print job is not performed.

The image forming apparatus enters the power save mode if the print job is not performed for predetermined time. In the power save mode, power is not supplied to unused elements, i.e., an image forming unit, a scanning unit, and a user interface (UI) unit to thereby reduce power consumption.

In general, the image forming apparatus is set not to supply power to the finisher when the power mode enters the power save mode.

The finisher includes a medium arranger including a pair of tempers to arrange an ejected print medium, and a stacker which is provided below the medium arranger and stacks print medium thereon.

If the image forming apparatus receives a print command including a finishing option, it forms an image on a print medium, transports the print medium having the image thereon to an ejector of a finisher, and arranges and performs a finishing job to the print medium, and then the finished print medium is stacked on the stacker. Such finishing jobs are generally performed by job.

However, if the image forming job is suspended by reasons of lack of print medium while the job corresponding to the print command is not completed, the finisher should wait with the print medium located in the medium arranger until the print medium is resupplied to the image forming apparatus and the image forming job is resumed.

If predetermined time elapses and the image forming apparatus enters the power save mode, the power supplied to the finisher is shut off.

If the print medium is resupplied after the image forming apparatus enters the power save mode, the image forming apparatus changes from the power save mode to a warming-up mode by the resupplied medium and power is resupplied to the finisher.

Then, the finisher undergoes an initialization process according to the resupply of power.

The print medium which was located in the medium arranger falls to the stacker without any finishing job performed, and the resupplied print medium is ejected to the medium arranger and the job suspended together with the finishing job is completed.

For example, with respect to a job including a stapling job as a finishing option for 30 sheets of print medium, the job may not be completed due to lack of paper while 17 sheets of print medium are located in the medium arranger and the image forming apparatus may enter the low power mode.

If the print medium are resupplied afterwards, the 17 sheets of print medium are stacked on the stacker without the finishing job performed due to the initialization of the finisher. Then, when the job is completed, there are 17 sheets of unstapled print medium and 13 sheets of stapled print medium.

SUMMARY

Accordingly, one or more exemplary embodiments provide an image forming apparatus and a power control method thereof which keeps supplying power to a finisher when an image forming apparatus enters a power save mode while there is an ongoing job, and prevents a failure to perform a normal finishing job due to an initialization of the finisher in a normal mode.

Another exemplary embodiment is to provide an image forming apparatus and a power control method thereof which stores information of an ongoing job and shuts off power supplied to a finisher, controls the finisher which receives power again not to perform an initialization job according to the stored information when a power save mode is changed to a normal mode, and normally completes a job including a finishing job.

Still another exemplary embodiment is to provide an image forming apparatus and a power control method thereof which allows a user to select a power supply or non-supply to a finisher in a power save mode and provides a user with various options.

The foregoing and/or other aspects may be achieved by providing a power control method of an image forming apparatus which includes a finisher to perform at least one of finishing jobs including arranging, sorting, grouping, folding, stapling, binding and punching a print medium which is ejected after an image is formed thereon, the power control method including: determining whether or not a power mode of the image forming apparatus meets requirements for entering a power save mode in which power supplied to a part of elements of the image forming apparatus is shut off; determining whether or not the image forming apparatus has an ongoing job if the requirements for entering the power save mode are met; and entering the image forming apparatus in the power save mode while the power supply to the finisher is maintained if the image forming apparatus has the ongoing job.

The power control method may further include determining whether or not the ongoing job requires the at least one of the finishing jobs.

The power control method may further include determining whether or not the power mode meets requirements for entering a normal mode from the power save mode; and changing the power mode of the image forming apparatus to the normal mode if the requirements for entering the normal mode are met.

The power control method may further include completing the ongoing job if the power mode is changed to the normal mode.

The foregoing and/or other aspects may be achieved by providing a power control method of an image forming apparatus which includes a finisher to perform at least one of finishing jobs including arranging, sorting, grouping, folding, stapling, binding and punching a print medium which is ejected after an image is formed thereon, the power control method including: determining whether or not a power mode of the image forming apparatus meets requirements for entering a power save mode in which power supplied to a part of elements of the image forming apparatus is shut off; determining whether or not the image forming apparatus has an ongoing job if the requirements for entering the power save mode are met; storing initialization skip information of the finisher in a storage unit if the image forming apparatus has the ongoing job; and shutting off power supplied to the finisher and entering the image forming apparatus in the power save mode.

The power control method may further include determining whether or not the ongoing job requires the at least one of the finishing jobs.

The power control method may further include determining whether or not the power mode meets requirements for entering a normal mode from the power save mode; and identifying the initialization skip information stored in the storage unit if the requirements for entering the normal mode are met.

The power control method may further include changing a power mode of the image forming apparatus to the normal mode while the initialization of the finisher is skipped; and completing the ongoing job if the power mode is changed to the normal mode.

The foregoing and/or other aspects may be achieved by providing a power control method of an image forming apparatus which includes a finisher to perform at least one of finishing jobs including arranging, sorting, grouping, folding, stapling, binding and punching a print medium which is ejected after an image is formed thereon, the power control method including: receiving a user's selection relating to power supply/non-supply to the finisher when a power mode of the image forming apparatus enters a power save mode in which power supplied to a part of elements of the image forming apparatus is shut off; determining whether or not the image forming apparatus meets requirements for entering the power save mode; determining whether or not the image forming apparatus has an ongoing job if the requirements for entering the power save mode are met; and shutting off selectively power supplied to the finisher corresponding to a user's selection and entering the image forming apparatus in the power save mode if the image forming apparatus has the ongoing job.

The power control method may further include storing initialization skip information of the finisher in a storage unit if the image forming apparatus has the ongoing job in a case when a user selects to shut off power supplied to the finisher at the time of entering the power save mode.

The foregoing and/or other aspects may be achieved by providing an image forming apparatus including: a power supply which supplies operating power; an image forming unit which forms an image on a print medium; a finisher which performs at least one of finishing jobs including arranging, sorting, grouping, folding, stapling, binding and punching the print medium which is ejected after the image is formed thereon; and a controller which determines whether or not a power mode of the image forming apparatus meets requirements for entering a power save mode in which power supplied to a part of elements of the image forming apparatus is shut off, determines whether or not the image forming apparatus has an ongoing job if the requirements for entering the power save mode are met, and controls the power supply for the image forming apparatus to enter the power save mode while power supply to the finisher is maintained if the image forming apparatus has the ongoing job.

The controller may determine whether or not the ongoing job requires the at least one of the finishing jobs.

The controller may determine whether or not the power mode meets requirements for entering a normal mode from the power save mode, and control the power supply to change the power mode of the image forming apparatus to the normal mode if the requirements for entering the normal mode are met.

The controller may control the image forming unit and the finisher to complete the ongoing job if the power mode is changed to the normal mode.

The foregoing and/or other aspects may be achieved by providing an image forming apparatus including: a power supply which supplies operating power; an image forming unit which forms an image on a print medium; a finisher which performs at least one of finishing jobs including arranging, sorting, grouping, folding, stapling, binding and punching the print medium which is ejected after the image is formed thereon; a storage unit; and a controller which determines whether or not a power mode of the image forming apparatus meets requirements for entering a power save mode in which power supplied to a part of elements of the image forming apparatus is shut off, determines whether or not the image forming apparatus has an ongoing job if the requirements for entering the power save mode are met, stores initialization skip information of the finisher in the storage unit if the image forming apparatus has the ongoing job, and controls the power supply to shut off power supplied to the finisher and to enter the image forming apparatus in the power save mode.

The controller may determine whether or not the ongoing job requires the at least one of the finishing jobs.

The controller may determine whether or not the power mode meets requirements for entering the normal mode from the power save mode, and identify the initialization skip information stored in the storage unit if the requirements for entering the normal mode are met.

The controller may control the power supply to change the power mode of the image forming apparatus to the normal mode while the initialization of the finisher is skipped, and control the image forming unit and the finisher to complete the ongoing job if the power mode is changed to the normal mode.

The foregoing and/or other aspects may be achieved by providing an image forming apparatus including: a power supply which supplies operating power; an image forming unit which forms an image on a print medium; a finisher which performs at least one of finishing jobs including arranging, sorting, grouping, folding, stapling, binding and punching the print medium which is ejected after the image is formed thereon; a user interface (UI) unit which receives a user's selection for a power supply/non supply to the finisher if a power mode of the image forming apparatus enters a power save mode in which power supplied to a part of elements of the image forming apparatus is shut off; and a controller which determines whether or not a power mode of the image forming apparatus meets requirements for entering a power save mode, determines whether or not the image forming apparatus has an ongoing job if the requirements for entering the power save mode are met, and controls the power supply to selectively shut off power supplied to the finisher corresponding to the user's selection and to enter the image forming apparatus in the power save mode if the image forming apparatus has the ongoing job.

The image forming apparatus may further include a storage unit, and the controller may store initialization skip information of the finisher in the storage unit if there is the ongoing job and a user selects to shut off power supplied the finisher through the user interface unit when the image forming apparatus enters the power save mode.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
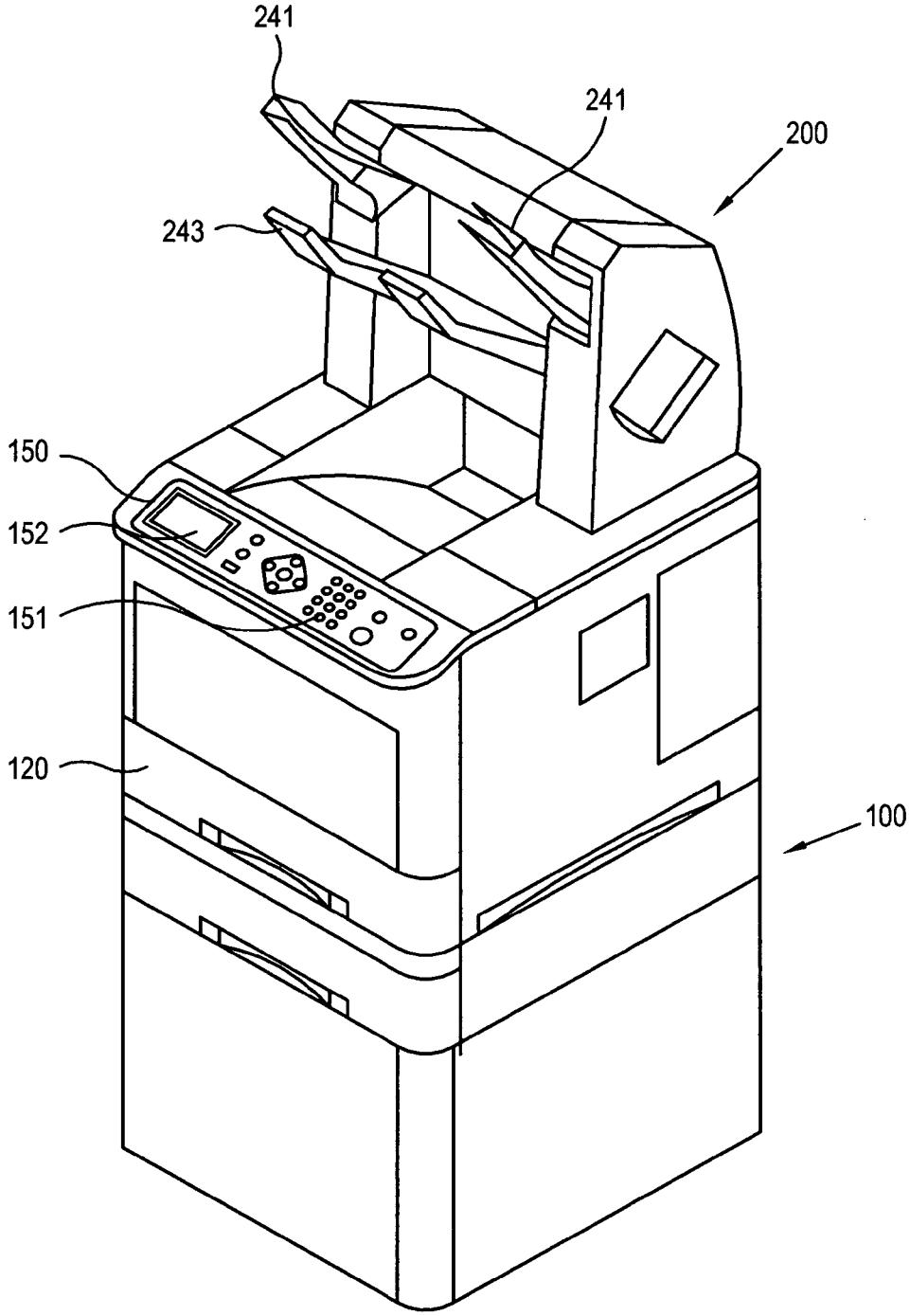
FIG. 1 is a schematic perspective view of an image forming apparatus according to an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Figure 2:
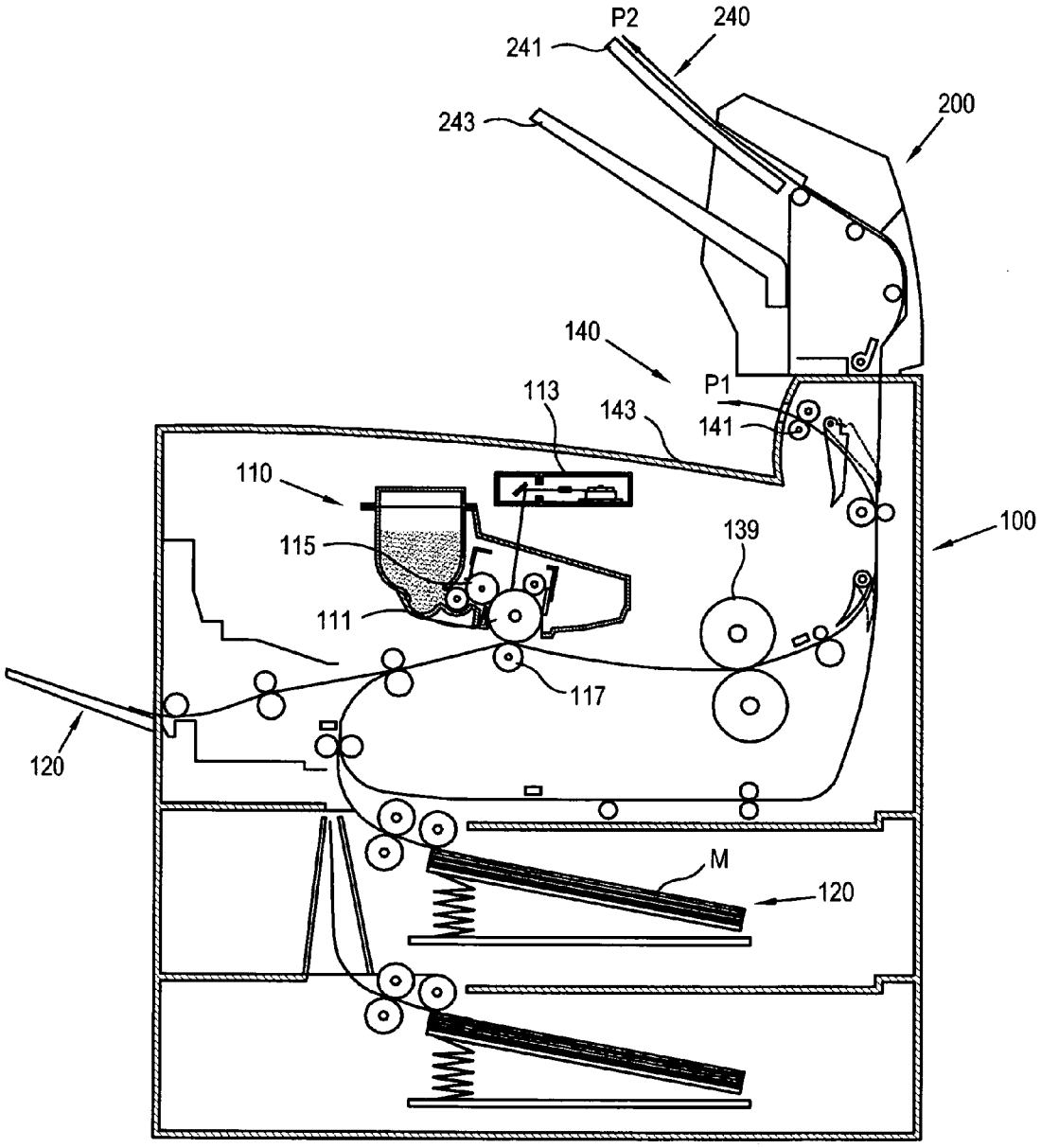
FIG. 2 is a schematic sectional view of the image forming apparatus according to the exemplary embodiment.
Figure 3:
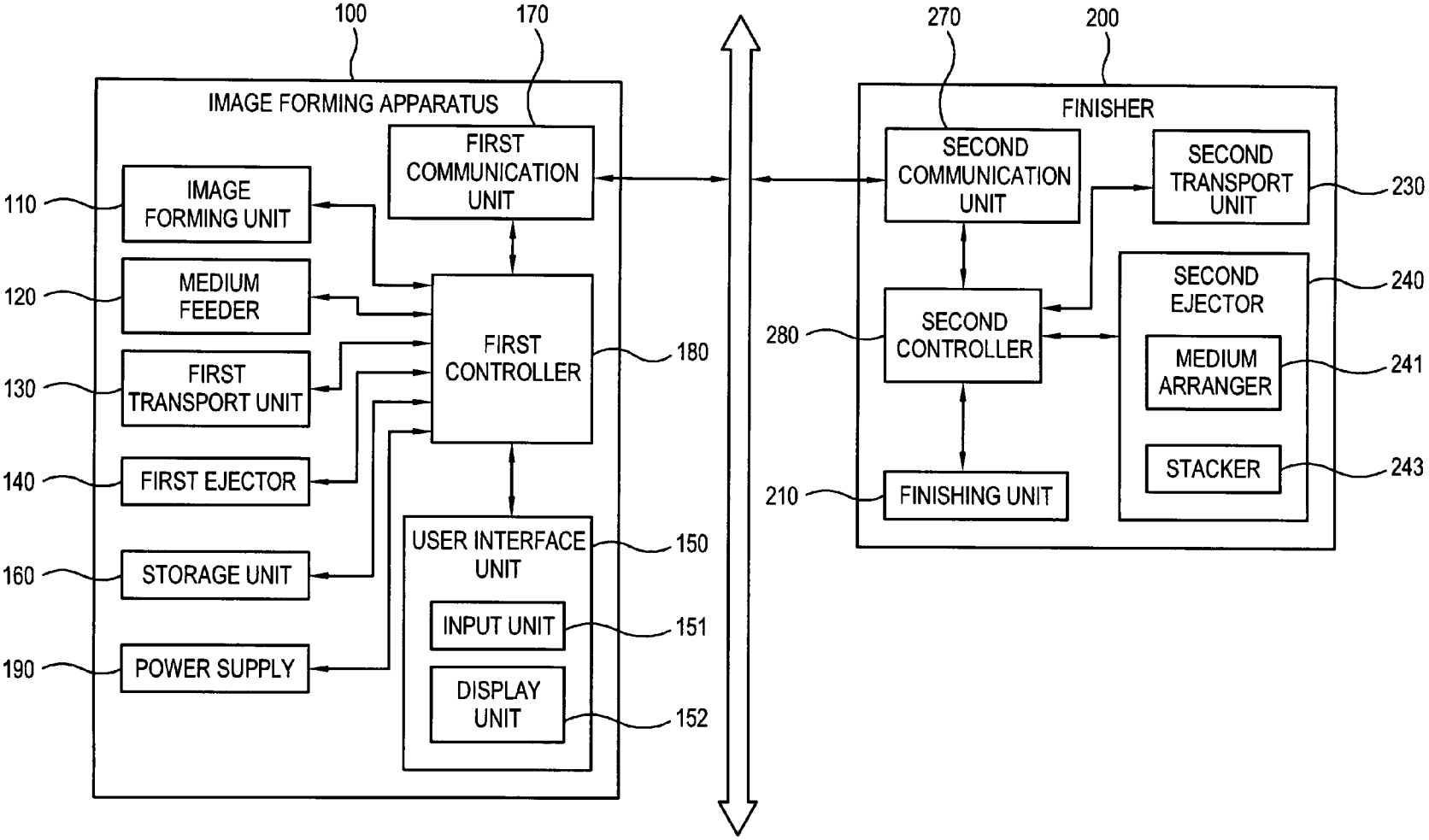
FIG. 3 is a block diagram of a control process of the image forming apparatus according to the exemplary embodiment.
Figure 4:
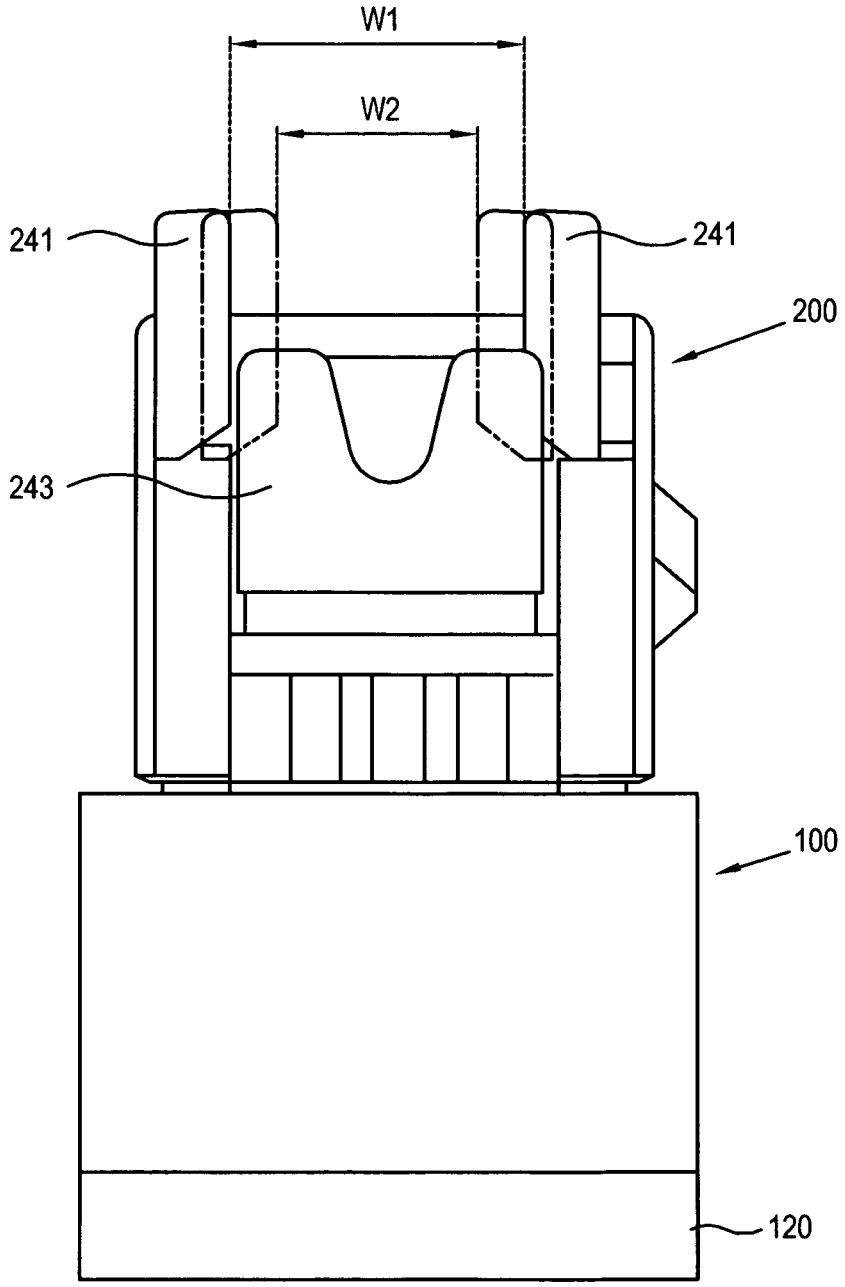
FIG. 4 is a front view of the image forming apparatus according to the exemplary embodiment.
Figure 5:
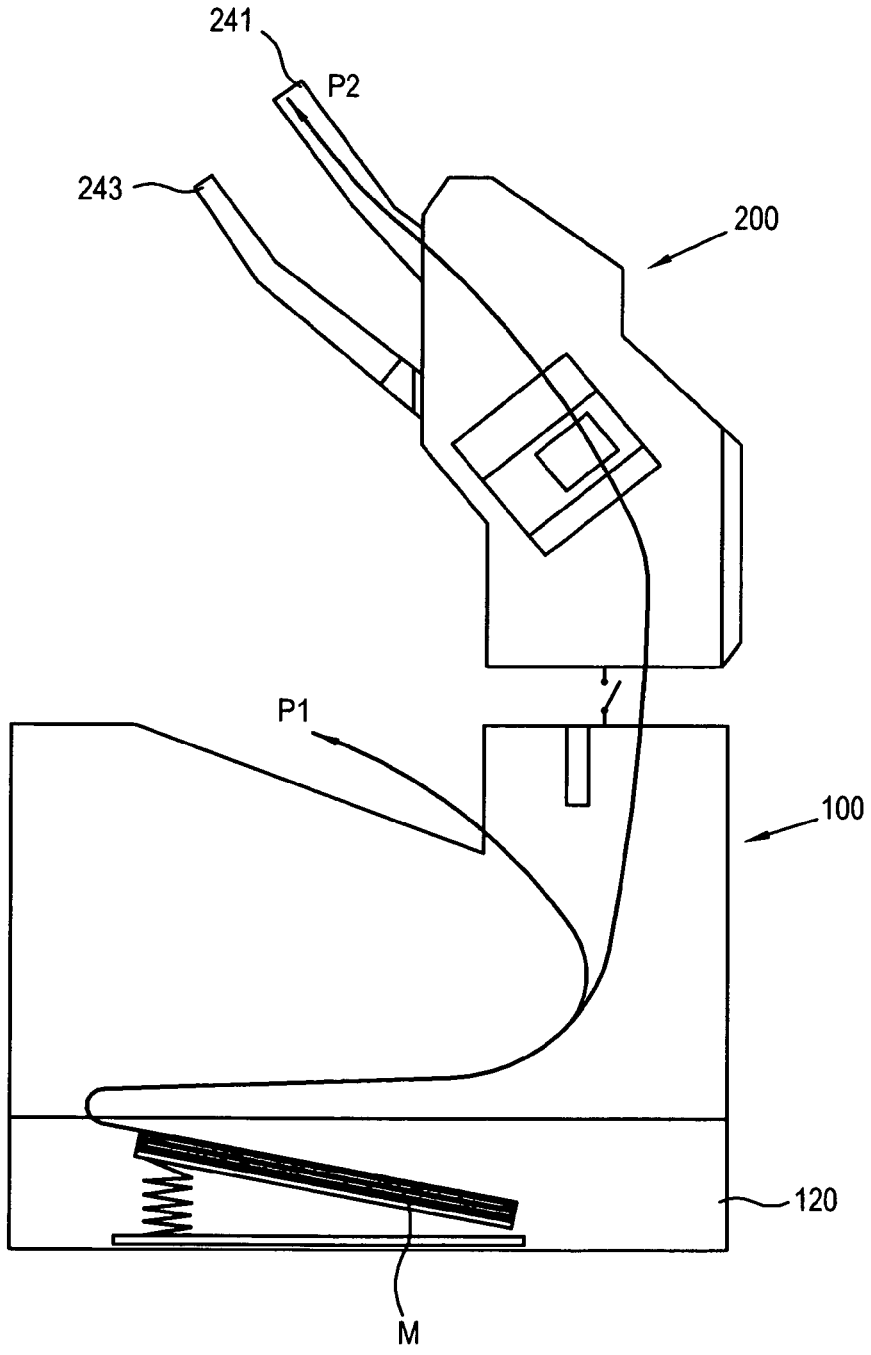
FIG. 5 is a lateral view of the image forming apparatus and a finisher according to the exemplary embodiment.

FIG. 1 is a schematic perspective view of an image forming apparatus according to an exemplary embodiment. FIG. 2 is a schematic sectional view of the image forming apparatus according to the exemplary embodiment. FIG. 3 is a block diagram of a control process of the image forming apparatus according to the exemplary embodiment. FIG. 4 is a front view of the image forming apparatus according to the exemplary embodiment. FIG. 5 is a lateral view of the image forming apparatus according to the exemplary embodiment.

An image forming apparatus 100 according to a exemplary embodiment may include a printer, a photocopier, a facsimile, or a multi-function peripheral (MFP) having two or more functions.

The image forming apparatus 100 according to the exemplary embodiment may be connected to a finisher 200 which performs a finishing job to a print medium which is ejected after an image is formed thereon.

The finisher 200 is a kind of an optional device, and may be connected to the image forming apparatus 100 through a communication interface channel, for example, such as Universal Asynchronous Receiver Transmitter (UART) or a universal serial bus (USB).

As shown therein, the finisher 200 is connected to a side, e.g., an upper side of the image forming apparatus 100 and performs a finishing job with respect to a print medium which is ejected after an image is formed thereon.

If a print command including a finishing option is received, the image forming apparatus 100 transports and ejects a print medium fed by a medium feeder 120 to a second ejector 240 of the finisher 200 along a transport path P1 of the image forming apparatus 100 and a transport path P2 of the finisher 200.

If the print command does not include the finishing option, the image forming apparatus 100 transports the print medium along the transport path P1 and ejects the print medium to a first ejector 140 of the image forming apparatus 100.

In FIGS. 1 and 2, the finisher 200 is an additional device and coupled to one side of the image forming apparatus 100, but not limited thereto. Alternatively, the finisher 200 may be a part of the image forming apparatus 100.

Hereinafter, the finisher 200 will be described as a detachable additional device as an example, but the finisher 200 may be provided separately from the image forming apparatus 100 and connected to the image forming apparatus 100 through a communication interface or may be included in the image forming apparatus 100.

Referring to the drawings, the image forming apparatus 100 according to the exemplary embodiment includes an image forming unit 110, the medium feeder 120, a first transport unit 130, the first ejector 140, a user interface (UI) unit 150, a storage unit 160, a first communication unit 170, a first controller 180, and a power supply 190. The UI unit 150 may include an input unit 151 and a display unit 152. The image forming apparatus 100 may further include a scanner (not shown) which scans an image and generates a scan image, a fax unit which transmits and receives fax data or the like.

Upon receiving a print command, the image forming unit 110 forms an image on at least one print medium (paper) based on print data. The print job includes printing a scan document for copying, printing received fax data, and printing print data received from the outside through a host apparatus 200 including a server, or stored in an inside of the image forming apparatus 100 (for example, HDD) or an outside thereof (for example, USB memory device).

FIG. 2 illustrates the image forming unit 110 which forms a mono image by an electrophotographic method. Referring to FIG. 2, the image forming unit 110 includes an image carrier 111, a light scanning unit 113 which scans laser beam to the image carrier 111 and forms a latent image, a developing unit 115 which develops a toner image with respect to the latent image, a transfer unit 117 which transfers the image from the image carrier 111 to a print medium M transported along the transport paths P1 and P2, and a fusing unit 139 which fuses the image transferred to the print medium M.

In the exemplary embodiment, the image forming unit 110 forms a mono image on the print medium by an electrophotographic method, but not limited thereto. Alternatively, the image forming unit 110 may form an image by an inkjet or heat transfer method.

The image forming apparatus 100 according to the exemplary embodiment includes a single color image forming apparatus which forms an image by using a single color developer (generally, black color), a color image forming apparatus which forms a color image by using a four color developer, and a multi-color image forming apparatus which forms a color image by using an auxiliary developer such as a white color developer in addition to the four color developer.

The medium feeder 120 feeds the print medium M to the image forming unit 110, and includes at least one paper feeding tray on which the print medium M is stacked. The medium feeder 120 includes an automatic document feeder (ADF) and a duplex automatic document feeder (DADF) depending on the print medium feeding type, and may further include a pickup roller which picks a print medium from the paper feeding tray. The paper feeding tray includes at least one of a paper feeding cassette, a manual feeding tray, and an optional tray.

The first transport unit 130 includes a transport belt which transports the print medium fed by the medium feeder 120 to the image forming unit 110.

The first transport unit 130 transports the print medium M along the transport path P1 as in FIG. 1 by a control of the first controller 180 if the print command does not include the finishing option. The transported print medium M is ejected through the first ejector 140.

If the print command includes the finishing option, the first transport unit 130 transports the print medium from the medium feeder 120 to the transport path P2 of the finisher 200 through the transport path P1 of the image forming apparatus 100 in FIG. 1 by a control of the first controller 180. The finisher 200 transports the print medium from the image forming apparatus 100 along the transport path P2 and ejects the print medium through the second ejector 240.

The first ejector 140 includes an ejecting roller 141 which ejects the print medium having the image thereon to the outside of the image forming apparatus 100, and a bin 143 which accommodates therein the ejected print medium.

The UI unit 150 receives a user's command and displays a result of the command.

As shown in FIG. 1, the UI unit 150 includes the input unit 151 which receives a command from a user, and the display unit 152 which displays a setting and a job status of the image forming apparatus 100.

The input unit 151 includes a key button (hereinafter, to be also called hard key or a key pad) provided in the image forming apparatus 100, and a graphic user interface (GUI) which is generated by an execution of a predetermined application and displayed on the display unit 152 to receive a user's input by touch.

The display unit 152 may include a liquid crystal display (LCD) panel and a driver to drive the LCD panel.

A user may select whether or not to supply power to the finisher 200 through the UI unit 150 if the image forming apparatus 100 enters a power save mode while performing a job such as a print job.

The image forming apparatus 100 according to the exemplary embodiment stores initialization skip information of the finisher 200 in the storage unit 160 (to be described later) if a user selects to shut off power supplied to the finisher 200 in the power save mode.

A user may perform a log-in process to receive an ID and password assigned to each user account through the UI unit 150. The log-in includes a log-in to an administrator mode in which a setting and change to the entire environment of the image forming apparatus 100 is available without any additional access limit. If a. user log-in or administrator log-in is performed, the image forming apparatus 100 identifies and permits the access of such log-in.

A setting value which is set by the UI interface 150 is stored in the storage unit 160.

The storage unit 160 may further store therein print data or fax data received from the outside, a scan image generated by a scanning unit, user registration information, user authentication information, usage authorization information set for each user account, and other various information in addition to various setting values of the image forming apparatus 100.

The storage unit 160 includes an internal storage medium, for example, such as an hard disk drive (HDD) or an external or portable storage medium, for example, such as a USB memory device, and a memory card (memory stick, CF card and MMC).

The storage unit 160 of the image forming apparatus 100 according to the exemplary embodiment may include an additional non-volatile memory which stores therein initialization skip information (or finishing job remainder information) of the finisher 200. The non-volatile memory may include a buffer in which the initialization skip information is recorded.

The non-volatile memory which stores therein the initialization skip information may be provided in the finisher 200 as the case may be.

The first controller 180 may store the initialization skip information of the finisher 200 in the storage unit 160 for the finisher 200 not to perform an initialization job even upon resupply of power in a power off mode if the image forming apparatus 100 enters the power save mode while the job including the finishing option is not completed.

If the suspended job is completed as the image forming apparatus 100 is warmed up, the initialization skip information stored in the storage unit 160 may be deleted.

If the job is not completed, the finisher 200 is driven without the initialization job when the power save mode is changed to the normal mode, and errors in the finishing job are prevented from occurring.

The first communication unit 170 performs a data communication with the finisher 200 and an external device including a host apparatus (not shown).

The first communication unit 170 may include a wired/wireless communication module which is connected to the finisher 200 and an external device, for example, such as a host apparatus (not shown) in a network by a predetermined protocol, or a communication interface channel, for example, such as a USB or UART.

Upon receiving a print command, the first controller 180 controls the image forming unit 110 to form an image on a print medium fed by the medium feeder 120, and controls the first transport unit 130 to transmit the print medium having the image thereon.

If the received print command includes the finishing option, the first controller 180 controls a transport path of the first transport unit 130 to eject the print medium to the finisher 200, and controls the first communication unit 170 to generate and transmit a command controlling a transport path of the second transport unit 230 of the finisher 200 to the finisher 200. The first controller 180 may control the first communication unit 170 to transmit the print command including the finishing option to the finisher 200.

The power supply 190 supplies operating power to elements of the image forming apparatus 100 and the finisher 200 by a control of the first controller 180.

The image forming apparatus 100 according to the exemplary embodiment may have a power save mode (hereinafter, to be also called a low power mode) in which power supplied to a part of elements is shut off to save power consumption when the print job is not performed.

More specifically, the first controller 180 controls the power supply 190 to enter the power save mode if preset time elapses without the performance of the print operation. The first controller 180 controls the power supply 190 not to supply power to elements which are not used in the power save mode, i.e., the image forming unit 110 and the UI unit 150.

The image forming apparatus 100 may include an additional power save button (not shown) which receives a user's command to enter the power save mode, and may enter the power save mode if a user's input to the power save button is detected.

The finisher 200 ejects the print medium from the first transport unit 130 of the image forming apparatus 100 to the second ejector 240 through the second transport unit 230, and performs the finishing job to the ejected print medium.

As shown therein, the finisher 200 includes a finishing unit 210, the second transport unit 230, the second ejector 240, the second communication unit 270 and a second controller 280. The second ejector 240 includes the medium arranger 241 and the stacker 243.

The finishing unit 210 performs a predetermined finishing job to the printed print medium. The finishing job includes binding the print medium by applying glue to a part of the print medium to make a book with the print medium, folding a part of the print medium, stapling the print medium, and punching a part of the print medium.

The finisher 200 according to the exemplary embodiment may further perform arranging, sorting, and grouping jobs to the print medium as the finishing job.

As in FIG. 4, the medium arranger 241 may include a pair of tempers which are spaced from each other at a predetermined interval, and moves to the left and right and arranges the print medium to perform the finishing job easily. That is, the tempers temporarily accommodate and cool the print medium which is ejected after the print job is completed, and guide and arrange sides of the print medium if a predetermined number of print medium are stacked on the tempers, and stack the print medium on the stacker 243 provided below.

A space between the pair of tempers of the medium arranger 241, i.e., a width (VV1, W2) of the pair of the tempers is controlled corresponding to the width of the print medium depending on the type of the ejected print medium, i.e., a size of the print medium.

The second transport unit 230 includes a transport belt which receives and transports the print medium from the first transport unit 130 of the image forming apparatus 100. The second transport unit 230 transports the print medium along the transport path P2 in FIGS. 2 and 5.

The second ejector 240 further includes an ejecting roller (not shown) which ejects the printed print medium for the finishing job.

The second communication unit 270 performs a data communication with the image forming apparatus 100. More specifically, the second communication unit 270 receives a command from the image forming apparatus 100 to control the width of the medium arranger 241.

The second communication unit 270 may include a wired/wireless communication module which is connected to the image forming apparatus 100 in a network by a predetermined protocol, or a communication interface channel such as a USB or a UART.

Upon receiving the notification from the image forming apparatus 100 through the second communication unit 270 that the print command includes the finishing option, the second controller 280 controls the second transport unit 230 to receive and transport the print medium from the first transport unit 130 of the image forming apparatus 100 along the transport path P2, and controls the second ejector 240 to eject the transported print medium.

The finisher 200 according to the exemplary embodiment receives power, or is shut off from power supply depending on the power mode of the image forming apparatus 100.

More specifically, the first controller 180 of the image forming apparatus 100 controls the power supply 190 to enter the warming-up mode upon receiving a job performing command, for example, such as a print job when power is initially supplied or in the power save mode.

In the warming-up mode, power is also supplied to the finisher 200. If power is supplied while the finisher 200 is turned off, the initialization job of the finisher 200 is performed. The initialization job is performed at the time when the image forming apparatus 100 enters the warming-up mode and the connection (mounting) of the finisher 200 is initially recognized.

The finisher 200 performs a recovery job as the initialization job. For example, if the finisher 200 is jammed or does not operate efficiently due to mechanical problem, for example, an event such as opening/closing a door may be performed as the recovery job when the image forming apparatus 100 enters the warming up mode.

If the warming-up is completed, the image forming apparatus 100 becomes a ready mode in which an image forming job is available. The initialization job of the finisher 200 may be performed in the ready mode as the case may be. For example, if the finisher 200 is mounted in the image forming apparatus 100, the finisher 200 may perform the initialization job in the ready mode.

Upon receiving the print command in the state when the warming-up is completed or in the ready mode, the image forming apparatus 100 is changed to a normal mode (hereinafter, to be also called image forming mode). In the normal mode, the first controller 180 controls the first communication unit 170 to transmit and receive information relating to the ejecting the print medium and the finishing job, with the finisher 200. The second controller 280 of the finisher 200 controls the second communication unit 270 to receive information relating to the ejecting the print medium and the finishing job from the image forming apparatus 100, and transmits the job status of the finisher 200, a location of the print medium, and error information to the image forming apparatus 100.

If the image forming apparatus 100 meets requirements for entering the power save mode while there is an ongoing job, the power supply to the finisher 200 according to a first or second exemplary embodiment is maintained or shut off.

Figure 6:
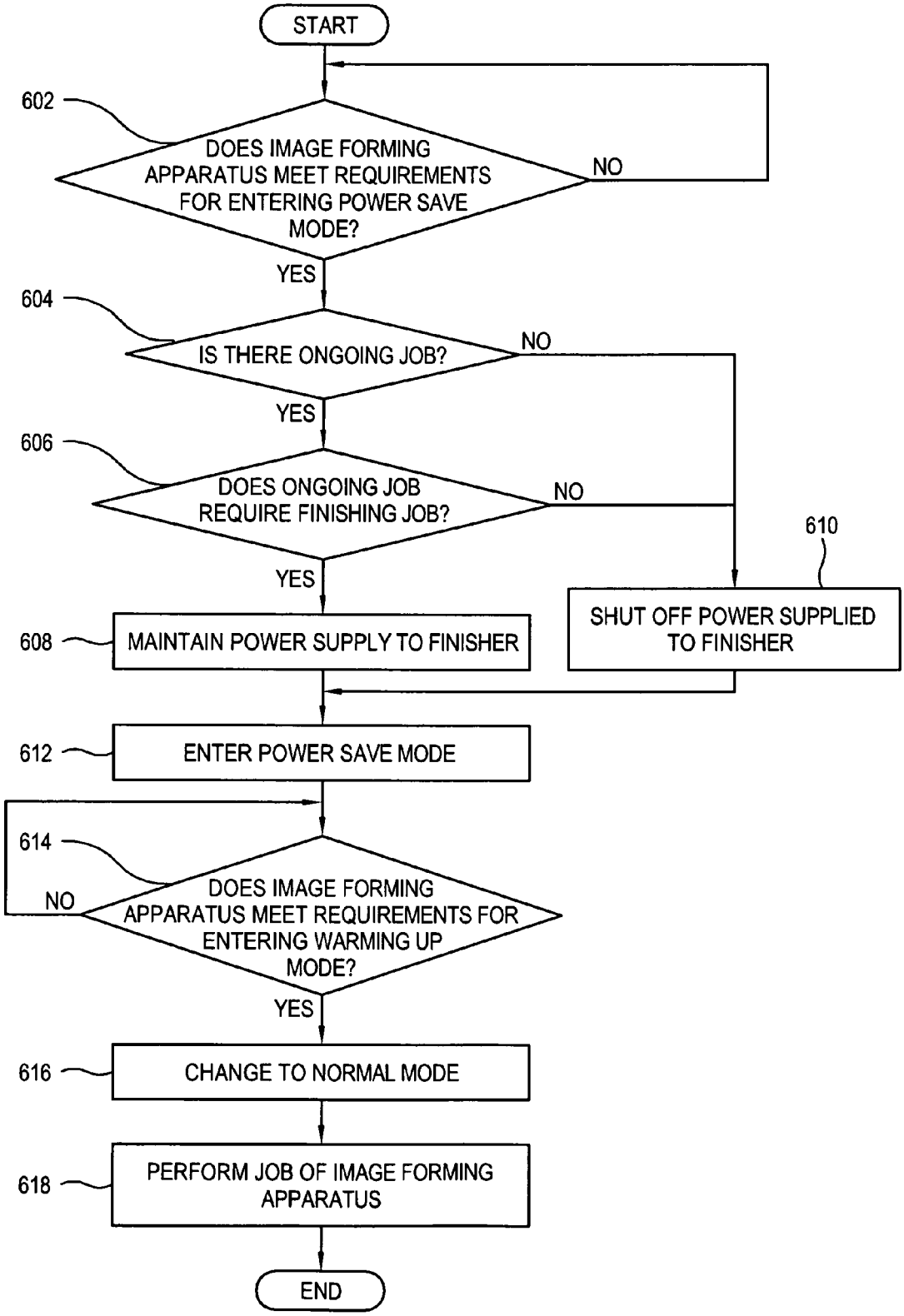
FIG. 6 is a flowchart of a power control method of an image forming apparatus according to a first exemplary embodiment.

FIG. 6 is a flowchart of a power control method of the image forming apparatus 100 according to the first exemplary embodiment.

The image forming apparatus 100 according to the first exemplary embodiment enters the power save mode when the print job, which had been performed by the print command including the finishing job, is suspended due to lack of print medium (paper) stacked in the medium feeder 120. For example, the image forming apparatus suspends its print job due to lack of 13 sheets of paper while 17 sheets of paper had been ejected to the medium arranger 241 with respect to a print command including a stapling job of 30 sheets of print medium.

As shown in FIG. 6, the first controller 180 determines whether or not the image forming apparatus 100 meets the requirements for entering the power save mode (602). Such requirements may be met if preset standby time elapses while the print job is suspended or if a user's input to the power save button is received.

If the requirements for entering the power save mode are met at operation 602, the first controller 180 determines whether or not the image forming apparatus 100 has an ongoing job (604).

If there is an ongoing job at operation 604, the first controller 180 determines whether or not the ongoing job requires the finishing job (606).

If it is determined that the finishing job is required, the first controller 180 controls the power supply 190 to maintain power supply to the finisher 200 (608). Then, the finisher 200 keeps receiving power while the 17 sheets of print medium are located in the medium arranger 241.

If there is no ongoing job at operation 604 or the finishing job is not required at operation 606, the first controller 180 shuts off power supplied to the finisher 200 (610).

The image forming apparatus 100 then enters the power save mode (612).

The first controller 180 may continue to monitor whether or not the image forming apparatus 100 meets the requirements for entering the warming-up mode (614). If the print medium are resupplied to the medium feeder 120, the image forming job is available and the requirements for entering the warming up mode are met.

If it is determined at operation 614 that the image forming apparatus 100 meets the requirements for entering the warming-up mode, the image forming apparatus 100 performs the warming-up operation and changes to the normal mode in which the image forming job is available (616). The finisher 200 keeps receiving power, and does not perform the additional initialization job.

If the image forming apparatus 100 changes to the normal mode at operation 616, the first controller 180 resumes the suspended job of the image forming apparatus 100 (618). Then, the print job is resumed with respect to the 13 sheets of print medium and the 13 sheets of printed print medium are ejected to the medium arranger 241 of the finisher 200.

The second controller 280 controls the medium arranger 241 to arrange a total of 30 sheets of print medium including the 17 sheets of print medium waiting before the entrance of the power save mode and the 13 sheets of print medium ejected after the resupply of paper, and controls the finishing unit 210 to perform the finishing job (e.g. stapling) with respect to the arranged print medium. The print medium which are finished are stacked on the stacker 243.

According to the first exemplary embodiment, even if the image forming apparatus 100 enters the power save mode before the job including the finishing job is completed, the power supply to the finisher 200 is maintained and the print job is performed without any error in the finishing job.

Figure 7A:
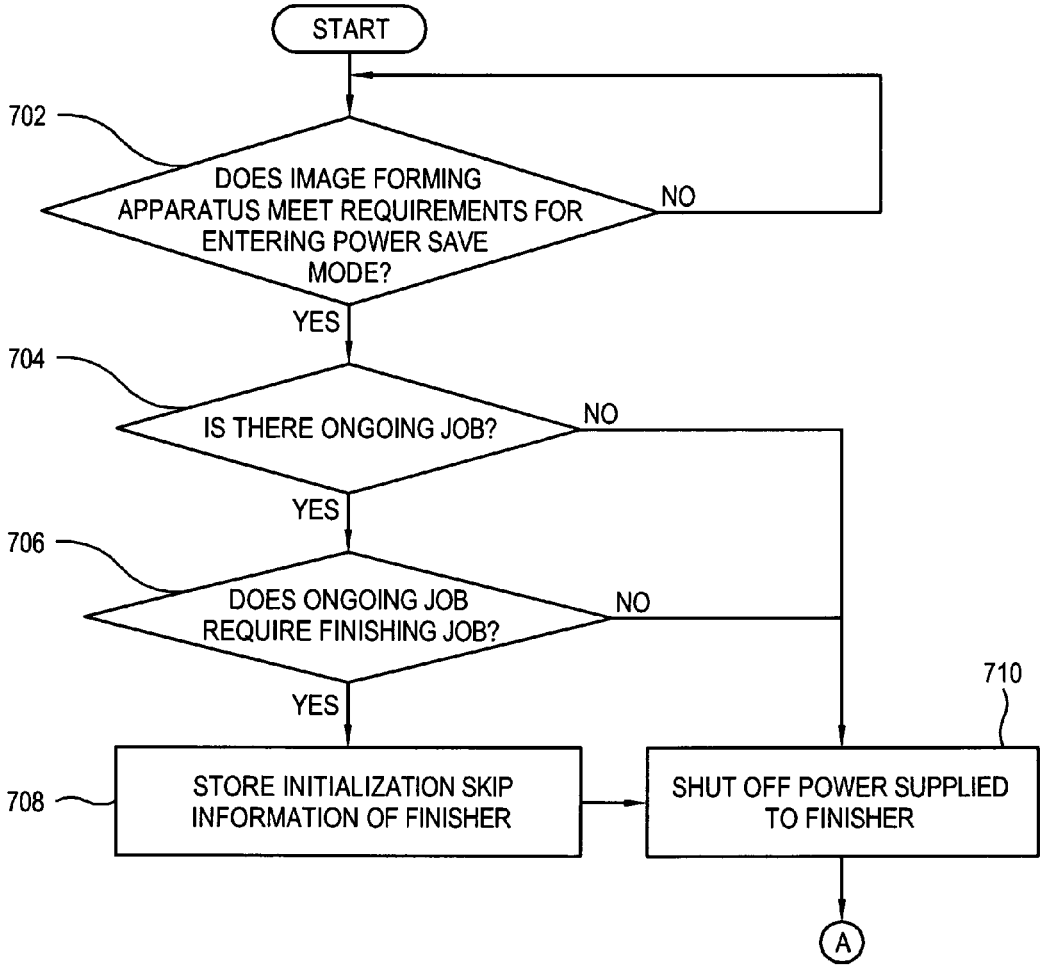
FIGS. 7A and 7B are flowcharts of a power control method of an image forming apparatus according to a second exemplary embodiment.
Figure 7B:
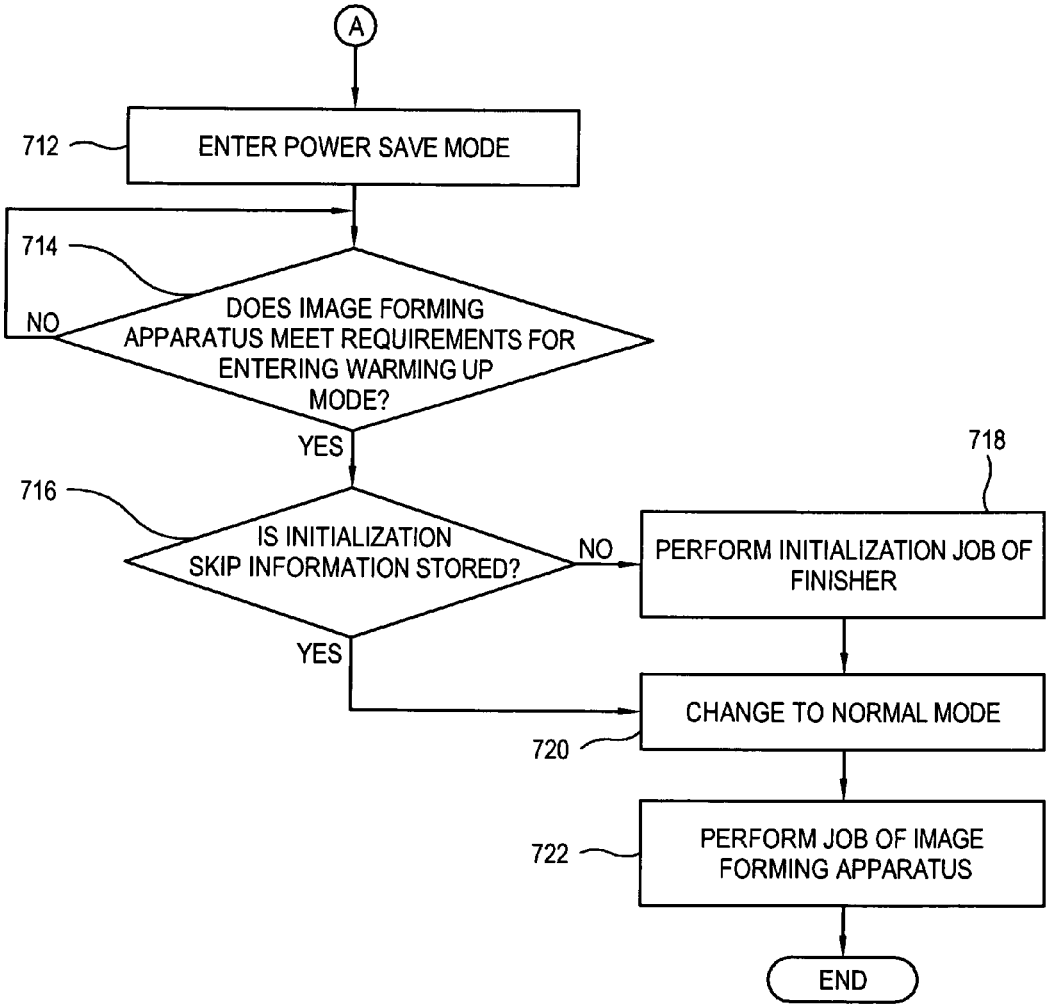

FIGS. 7A and 7B are flowcharts of a power control method of an image forming apparatus according to a second exemplary embodiment.

Like in the first exemplary embodiment, the image forming apparatus 100 according to the second exemplary embodiment enters the power save mode while the print job is suspended due to lack of print medium (paper) stacked in the medium feeder 120 with respect to the print command including the finishing job. For example, the image forming apparatus 100 suspends its print job due to lack of 13 sheets of paper while 17 sheets of paper had been ejected to the medium arranger 241 with respect to a print command including a stapling job of 30 sheets of print medium.

As shown in FIG. 7A, the first controller 180 determines whether or not the image forming apparatus 100 meets the requirements for entering the power save mode (702). The requirements for entering the power save mode may be met if preset standby time elapses while the print job is suspended or a user's input to the power save button is received.

If the requirements for entering the power save mode are met at operation 702, the first controller 180 determines whether or not the image forming apparatus 100 has an ongoing job (704).

If there is an ongoing job at operation 704, the first controller 180 determines whether or not the ongoing job requires the finishing job (706).

If it is determined that the ongoing job requires the finishing job at operation 706, the first controller 180 stores the initialization skip information (or finishing job remainder information) of the finisher 200 in the storage unit 160 (708). The initialization skip information is information which is used to skip the initialization job if the finisher 200 is turned on again.

The first controller 180 controls the power supply 190 not to supply power to the finisher 200 (710). Then, power supplied to the finisher 200 is shut off while the 17 sheets of print medium are located in the medium arranger 241.

If there is no ongoing job at operation 704 or the ongoing job does not require the finishing job at operation 706, the first controller 180 shuts off power supplied to the finisher 200 (710).

Then, the image forming apparatus 100 enters the power save mode (712).

The first controller 180 may continue to monitor whether or not the image forming apparatus 100 meets the requirements for entering the warming-up mode (714). If the print medium are resupplied to the medium feeder 120, the image forming job is available and the requirements for entering the warming up mode are met.

If it is determined at operation 714 that the image forming apparatus 100 meets the requirements for entering the warming-up mode, the first controller 180 determines whether or not the storage unit 160 stores therein the initialization skip information (716).

If it is determined that the initialization skip information is stored, i.e., if the initialization skip information is stored in advance at operation 708, the image forming apparatus 100 performs the warming-up operation, and changes to a normal mode in which the image forming job is available (716). The finisher 200 does not perform the additional initialization job.

If it is determined that the initialization skip information is not stored at operation 716, the finisher 200 performs the initialization job (718). The initialization of the finisher 200 includes checking whether or not the elements operate normally, including loading the print medium located in the medium arranger 241 onto the stacker 243.

If the initialization of the finisher 200 is completed, the image forming apparatus 100 changes to the normal mode (720).

If the image forming apparatus 100 changes to the normal mode at operation 720, the first controller 180 resumes the suspended job of the image forming apparatus 100 (722). Then, the print job is performed with respect to the 13 sheets of print medium, and the 13 sheets of printed print medium are ejected to the medium arranger 241 of the finisher 200.

The second controller 280 controls the medium arranger 241 to arrange a total of 30 sheets of print medium including 17 sheets of print medium waiting before the entrance to the power save mode, and the 13 sheets of print medium ejected after the resupply of paper, and controls the finishing unit 210 to perform the finishing job (e.g., stapling job) with respect to the arranged print medium. The print medium which are finished are stacked on the stacker 243.

According to the second exemplary embodiment, if the image forming apparatus 100 enters the power save mode before the job including the finishing job is completed, the storage unit 160 stores therein the initialization skip information, and the power supplied to the finisher 200 is shut off to thereby normally perform the print job without errors in the finishing job as the initialization of the finisher 200 is skipped even in the case of resupply of power.

The image forming apparatus 100 according to the exemplary embodiment may selectively control power corresponding to the user's setting through the UI unit 150.

More specifically, if a user selects to keep supplying power to the finisher 200 while there is an ongoing job, the image forming apparatus 100 performs the power control according to the first exemplary embodiment. If a user selects to shut off power supplied to the finisher 200 while there is an ongoing job, the image forming apparatus 100 performs the power control according to the second exemplary embodiment.

The image forming apparatus 100 may be set to operate according to one of the first and second exemplary embodiments regardless of a user's selection as above.

As described above, an image forming apparatus and a power control method thereof according to an exemplary embodiment maintains power supply to a finisher when entering a power save mode while a job is performed, and prevents a failure to perform a finishing job due to an initialization of the finisher when the image forming apparatus changes to a normal mode, prevents waste of paper and unnecessary reprocessing and ensures continuity of operation.

Also, an image forming apparatus and a power control method thereof according to another exemplary embodiment stores information on an ongoing job and shuts off power supplied to a finisher, controls the finisher, which receives power again, to skip an initialization job according to the stored information when a power save mode is changed to a normal mode, and normally completes a job including a finishing job.

Further, an image forming apparatus and a power control method thereof according to another exemplary embodiment allows a user to select a power supply/non-supply to a finisher in a power save mode and provides a user with various options.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A power control method of an image forming apparatus which comprises a finisher to perform at least one of finishing jobs comprising arranging, sorting, grouping, folding, stapling, binding, and punching a print medium which is ejected after an image is formed thereon, the power control method comprising:

determining whether or not a power mode of the image forming apparatus meets requirements to enter a power save mode;

determining whether or not the image forming apparatus has an ongoing job including the at least one of the finishing jobs if the requirements to enter the power save mode are met;

if it is determined that the image forming apparatus has the ongoing job including the at least one of the finishing jobs, determining whether the ejecting of the printed medium to the finisher is completed; and if it is determined that the ejecting is not completed and the ongoing job is suspended such that the image forming apparatus enters the power save mode without completing the ongoing job, maintaining a power supply to the finisher when the image forming apparatus enters the power save mode, wherein if it is determined that the ongoing job requires the finishing job, storing an initialization skip information of the finisher in a storage unit, the initialization skip information being information used to skip performing an initialization of the finisher when the finisher is turned on again, and shutting off power supplied to the finisher when the image forming apparatus enters the power save mode.

2. The power control method according to claim 1, further comprising determining whether or not the power mode meets requirements to enter a normal mode from the power save mode; and changing the power mode of the image forming apparatus to the normal mode if the requirements to enter the normal mode are met.

3. The power control method according to claim 2, further comprising completing the ongoing job if the power mode is changed to the normal mode.

4. The power control method according to claim 1, further comprising determining whether or not the power mode meets requirements to enter a normal mode from the power save mode; and identifying the initialization skip information stored in the storage unit if the requirements to enter the normal mode are met.

5. The power control method according to claim 4, further comprising changing the power mode of the image forming apparatus to the normal mode from the power save mode while the performing of the initialization of the finisher is skipped by using the initialization skip information; and completing the ongoing job if the power mode is changed to the normal mode.

6. A power control method of an image forming apparatus which comprises a finisher to perform at least one of finishing jobs comprising arranging, sorting, grouping, folding, stapling, binding, and punching a print medium which is ejected after an image is formed thereon, the power control method comprising:

receiving a user's selection to supply or not to supply power to the finisher when a power mode of the image forming apparatus enters a power save mode;

determining whether or not the image forming apparatus meets requirements to enter the power save mode;

determining whether or not the image forming apparatus has an ongoing job including the at least one of the finishing jobs if the requirements to enter the power save mode are met; and if it is determined that the image forming apparatus has the ongoing job including the at least one of the finishing jobs, determining whether the ejecting of the printed medium to the finisher is completed;

if it is determined that the ejecting is not completed and the ongoing job is suspended such that the image forming apparatus enters the power save mode without completing the ongoing job, shutting off selectively the power supplied to the finisher corresponding to the user's selection when the image forming apparatus enters the power save mode, wherein if it is determined that the ongoing job requires the finishing job, storing an initialization skip information of the finisher in a storage unit, the initialization skip information being information used to skip performing an initialization of the finisher when the finisher is turned on again, and shutting off power supplied to the finisher when the image forming apparatus enters the power save mode.

7. The power control method according to claim 6, further comprising when a user selects to shut off power supplied to the finisher at the time of entering the power save mode and if it is determined that the image forming apparatus has the ongoing job, storing initialization skip information of the finisher in a storage unit, the initialization skip information being information used to skip performing an initialization of the finisher.

8. An image forming apparatus comprising:

a power supply which supplies operating power;

an image forming unit which forms an image on a print medium;

a finisher which performs at least one of finishing jobs comprising arranging, sorting, grouping, folding, stapling, binding, and punching the print medium which is ejected after the image is formed thereon;

an ejector to eject the print medium which the image is formed to the finisher; and a controller which determines whether or not a power mode of the image forming apparatus meets requirements to enter a power save mode, determines whether or not the image forming apparatus has an ongoing job including the at least one of the finishing jobs if the requirements to enter the power save mode are met, and if it is determined that the image forming apparatus has the ongoing job including the at least one of the finishing jobs, determines whether the ejecting of the printed medium to the finisher is completed, if it is determined that the ejecting is not completed and the ongoing job is suspended such that the image forming apparatus enters the power save mode without completing the ongoing job, controls the power supply to maintain the power supply to the finisher when the image forming apparatus enters the power save mode, wherein if it is determined that the ongoing job requires the finishing job, the controller which stores an initialization skip information of the finisher in a storage unit, the initialization skip information being information used to skip performing an initialization of the finisher when the finisher is turned on again, and shuts off power supplied to the finisher when the image forming apparatus enters the power save mode.

9. The image forming apparatus according to claim 8, wherein the controller determines whether or not the power mode meets requirements to enter a normal mode from the power save mode, and controls the power supply to change the power mode of the image forming apparatus to the normal mode if the requirements to enter the normal mode are met.

10. The image forming apparatus according to claim 9, wherein the controller controls the image forming unit and the finisher to complete the ongoing job if the power mode is changed to the normal mode from the power save mode.

11. The image forming apparatus according to claim 8, wherein the controller determines whether or not the power mode meets requirements to enter a normal mode from the power save mode, and identifies the initialization skip information stored in the storage unit if the requirements to enter the normal mode are met.

12. The image forming apparatus according to claim 11, wherein the controller controls the power supply to change the power mode of the image forming apparatus to the normal mode from the power save mode while the performing of the initialization of the finisher is skipped by using the initialization skip information, and controls the image forming unit and the finisher to complete the ongoing job if the power mode is changed to the normal mode.

13. An image forming apparatus comprising:

a power supply which supplies operating power;

an image forming unit which forms an image on a print medium;

a finisher which performs at least one of finishing jobs comprising arranging, sorting, grouping, folding, stapling, binding, and punching the print medium which is ejected after the image is formed thereon;

an ejector to eject the print medium which the image is formed to the finisher;

a user interface (UI) unit which receives a user's selection to supply or not to supply power to the finisher if a power mode of the image forming apparatus enters a power save mode; and a controller which determines whether or not a power mode of the image forming apparatus meets requirements to enter a power save mode, determines whether or not the image forming apparatus has an ongoing job including the at least one of the finishing jobs if the requirements to enter the power save mode are met, and if the image forming apparatus has the ongoing job including the at least one of the finishing jobs, determines whether the ejecting of the printed medium to the finisher is completed, and if it is determined that the ejecting is not completed and the ongoing job is suspended such that the image forming apparatus enters the power save mode without completing the ongoing job, controls the power supply to selectively shut off the power supplied to the finisher corresponding to the user's selection and to enter the image forming apparatus in the power save mode, wherein if it is determined that the ongoing job requires the finishing job, storing an initialization skip information of the finisher in a storage unit, the initialization skip information being information used to skip performing an initialization of the finisher when the finisher is turned on again, and shutting off power supplied to the finisher when the image forming apparatus enters the power save mode.

* * * * *